US007296380B2

(12) United States Patent
Bäckman

(10) Patent No.: US 7,296,380 B2
(45) Date of Patent: Nov. 20, 2007

(54) DEVICE FOR OPERATING A DOOR LEAF OR THE LIKE AND DOOR STRUCTURE PROVIDED WITH SUCH A DEVICE

(75) Inventor: Eric Bäckman, Landskrona (SE)

(73) Assignee: Besam International HP, Landskrona (SE)

( * ) Notice: Subject to any disclaimer, the term of this patent is extended or adjusted under 35 U.S.C. 154(b) by 0 days.

(21) Appl. No.: 10/398,773

(22) PCT Filed: Oct. 19, 2001

(86) PCT No.: PCT/SE01/02297

§ 371 (c)(1),
(2), (4) Date: Apr. 10, 2003

(87) PCT Pub. No.: WO02/33206

PCT Pub. Date: Apr. 25, 2002

(65) Prior Publication Data

US 2004/0035057 A1 Feb. 26, 2004

(30) Foreign Application Priority Data

Oct. 19, 2000 (SE) ..... 0003772

(51) Int. Cl.
*E05F 11/24* (2006.01)

(52) U.S. Cl. ..... 49/341; 49/340; 49/139; 74/89.35

(58) Field of Classification Search ..... 49/139, 49/140, 339, 340, 341; 74/89.12, 89.37, 74/89.35

See application file for complete search history.

(56) References Cited

U.S. PATENT DOCUMENTS

| | | | | |
|---|---|---|---|---|
| 2,075,000 | A | 3/1937 | McCloud | |
| 2,371,336 | A | 3/1945 | Levon | |
| 3,470,653 | A * | 10/1969 | Kalog | 49/139 |
| 3,653,154 | A | 4/1972 | Hayday | |
| 3,886,425 | A | 5/1975 | Weiss | |
| 4,220,051 | A | 9/1980 | Catlett | |
| 5,513,467 | A | 5/1996 | Current et al. | |
| 5,687,507 | A * | 11/1997 | Beran | 49/340 |
| 5,862,630 | A * | 1/1999 | Krumhauer et al. | 49/341 |
| 5,913,763 | A * | 6/1999 | Beran et al. | 49/506 |
| 6,412,224 | B1 * | 7/2002 | Feucht et al. | 49/340 |

FOREIGN PATENT DOCUMENTS

| | | |
|---|---|---|
| DE | 3730114 | 5/1988 |
| EP | 0169296 | 5/1987 |
| EP | 0632181 | 1/1995 |
| GB | 2020734 | 11/1979 |

* cited by examiner

*Primary Examiner*—Jerry Redman
(74) *Attorney, Agent, or Firm*—Harness, Dickey & Pierce, P.L.C.

(57) ABSTRACT

A device for opening and closing a pivotally mounted door leaf including an actuator, which is displaceably and/or rotatingly arranged in a housing and connected to the door leaf and which, during displacement/rotation, actuates the door leaf, and a drive motor which is connected to the actuator for providing displacement/rotation thereof.

14 Claims, 9 Drawing Sheets

DEVICE FOR OPERATING A DOOR LEAF OR THE LIKE AND DOOR STRUCTURE PROVIDED WITH SUCH A DEVICE

FIELD OF THE INVENTION

The present invention relates to a device for opening and closing a pivotally mounted door leaf or the like, in technical language also called a door opener. Devices of this kind are usually operated by an electric motor, but must also allow manual operation, see for instance U.S. Pat. No. 5,513,467.

BACKGROUND ART

GB-A-2,020,734 discloses a prior-art door opener, the purpose of which is to provide both motor-driven and manual operation of, for example, door leafs. A motor-driven opening or closing may, for instance, be initiated by someone passing a detection sensor, or by the person who desires to open the door pressing a button which activates the drive motor of the opener. For safety reasons, it is important that the door leaf can be opened manually. For example, if a power failure should occur, it must be possible to open the door leaf manually. Door openers of this type are often used in doors in public buildings such as hospitals, libraries, banks and shops. Such door openers are also used when tailoring buildings to the needs of disabled people.

One disadvantage associated with a door opener of this kind is that it has many components. It is, therefore, both complex and expensive to manufacture as well as bulky, which makes the installation difficult. The door opener is mounted either directly on the door leaf or on the wall above the door leaf. If the space between the upper edge of the door leaf and the ceiling is small, the door opener has to be mounted in a recess in the ceiling, which is a lengthy and expensive procedure. Moreover, in operation the complex structure causes an annoying sound level.

Although door openers of this kind allow manual conveniencing especially elderly and disabled people.

Furthermore, if the door is opened manually in a violent manner, either intentionally or by vandalizing kicks and violent blows, the door opener drive motor risks being damaged.

Further examples of prior art are the devices disclosed in DE-A 3 730 114, EP-A-169 296, EP-A-632 181, U.S. Pat. No. 2,371,336, U.S. Pat. No. 2,075,000, U.S. Pat. No. 3,886,425 and U.S. Pat. No. 3,653,154, which, however, also suffer from drawbacks described above.

SUMMARY OF THE INVENTION

The object of the present invention is to provide a solution to the above problems.

This and other objects, which will be obvious from the following description, have now been achieved by means of a device presenting the features defined in claim 1, with preferred embodiments in dependent claims 2-12. The objects are also achieved by means of a door structure having the features defined in the appended claims 13-14.

Thus, the two elements of the actuator included in the inventive device are interconnected by means of a biased spring means in such manner that the movement of the door leaf and the rotary movement of the drive motor, respectively, can be taken up by and stored in the spring means independently of each other.

The inventive device is particularly advantageous in that it consists of only a few components. Thus, the device is less expensive and less bulky than prior-art door openers. Owing to its reduced dimensions, the device may be easily mounted both on the door leaf itself and on the door frame above, or, alternatively, be built into the door leaf or the door frame. Consequently, no complicated installations in the ceiling or walls are needed. Furthermore, according to the invention, there is no connection between the actuating shaft and the drive motor, which means that the forces acting on the elements of the actuator can be absorbed independently of each other.

According to a first aspect of the invention, the two elements are telescopically interconnected, the biased spring means being contained in the two elements. This provides for a compact and space-saving solution.

Furthermore, the first element is axially displaceable in the casing, the second element being contained in the first element and axially displaceable therein.

Preferably, the first element has engaging means which engage corresponding engaging means of an actuating shaft projecting from the casing (10) and being adapted to actuate the door leaf, the drive motor being connected to the second element, which is contained in the first element.

Thus, according to this first aspect, the actuator is axially displaceable in the casing. The telescopic movements occurring in this embodiment between the two elements contained in the casing imply numerous advantages. First, a movement of the actuating shaft will not interfere with the motor. Instead, the movement of the actuating shaft causes the outer element to be axially displaced relative to the inner element, which through its connection to the motor will remain immobile. Thus, the drive motor will not be affected by a manual opening, as is the case in prior-art door openers, and, consequently, manual opening of the door leaf will be easier. Moreover, the risk of the motor being damaged or, at worst, breaking down as a result of an altogether too violent manual opening is eliminated. Second, the output of the motor can be reduced, since the action of the motor only results in the elements being jointly displaced in the casing, which actuates the actuating shaft and, thus, the door leaf. In this case, no components need to be compressed and the full output of the motor is used for the opening operation.

Furthermore, the spring means suitably comprises an axially biased pressure spring contained in the second element.

According to a second aspect of the invention, the first element comprises a trunnion, which is contained in the casing and enclosed by the second element and with the spring means arranged therebetween, the spring means comprising a torsion spring which at either end is connected to the elements.

Thus, the actuator is rotatably arranged in the casing, which basically gives the same advantages as stated above. This embodiment allows the dimensions of the device to be further reduced and makes it possible to mount the device directly on the door in a particularly simple manner. In special cases, the device may be arranged to operate directly adjacent the door leaf mounting, for instance adjacent to its hinges. A further advantage is that said reduction of the dimensions allows the door opener to be built into the door leaf or the door frame itself, which in turn is advantageous from an aesthetic point of view, since the door opener will not mar the overall appearance of the door and the surrounding environment.

Preferably, the spring means is arranged between and connected to the two elements included in the actuator.

The advantage thereof is that an effective action of the inventive device is easily obtained.

According to a third aspect of the invention, the elements of the actuator are intended for both axial displacement and rotation, the advantage thereof being simplified manufacture. Furthermore, the same advantages are obtained as described above in connection with the second aspect of the invention.

According to this third aspect of the invention, the spring means of the actuator serves both as a pressure spring and as a torsion spring. Since the pressure spring thus causes a rotary movement of the actuating shaft, the construction and manufacture are simplified.

Advantageously, a damper means is provided in the device to dampen the movements of the actuator. This prevents the closing speed of the door leaf from getting too high.

Preferably, the drive motor has a threaded motor shaft threadably engaging a threaded bearing at one end of the inner element. Consequently, no gear steps are needed between the motor and the actuator and, thus, the sound level of the device is reduced.

Furthermore, two sensors in the form of an angle sensor and a position sensor are preferably arranged adjacent to the motor shaft and along the first element, respectively. Thus, a relationship between the angle of rotation of the motor shaft, and thereby the axial position of the slide, and the axial position of the element can be established to improve the control of the door opener.

The above advantages are also obtained by means of a door structure according to the invention.

BRIEF DESCRIPTION OF THE DRAWINGS

The invention will be described in more detail below with reference to the accompanying schematic drawings, which, by way of example, illustrate currently preferred embodiments of the invention.

DESCRIPTION OF PREFERRED EMBODIMENTS

A device according to a first embodiment of the invention for operating a door leaf or the like will be described below and referred to as a door opener in accordance with common technical language. Door opener here implies that both opening and closing of the associated door leaf is possible.

Figure 1:
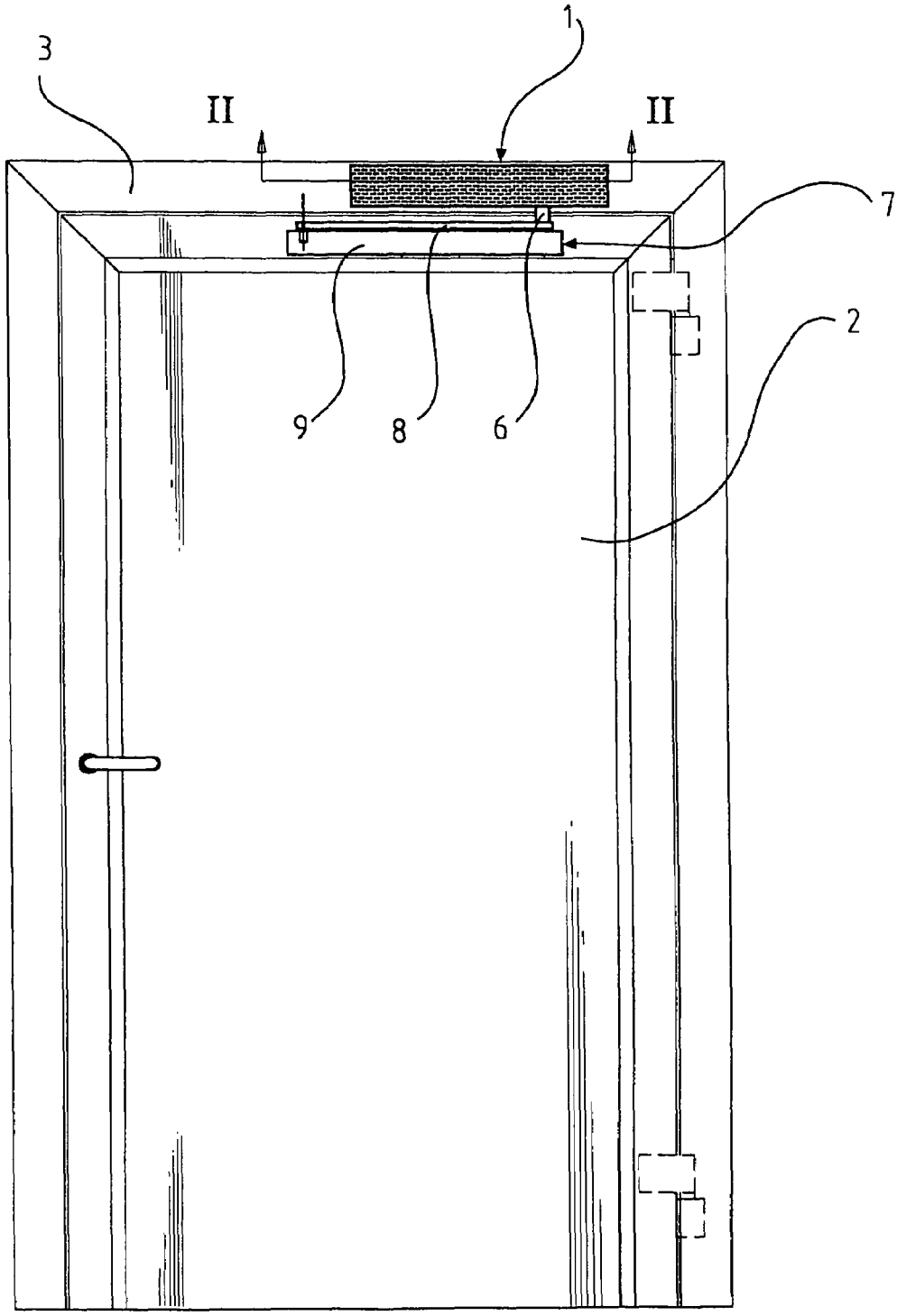
FIG. 1 is a schematic view of a device according to a first embodiment, which is mounted on a door frame above a door leaf.

FIG. 1 is a schematic view of a door opener 1 which is mounted above a pivotally mounted door leaf 2 for operation thereof. The door opener 1 is mounted on a door frame 3 associated with the door leaf 2. First and second mounting means 4, 5, illustrated in FIG. 2, allow attachment of the door opener 1 to the door frame 3. A perpendicularly (vertically) projecting actuating shaft 6 associated with the opener 1 is connected to the door leaf 2 by means of an arm system 7. The arm system 7 comprises an arm 8 extending parallel to the upper edge of the door leaf 2 and a fastening means 9 arranged on the door leaf 2 for securing one end of the arm 8 to the door leaf 2. The opposite end of the arm 8 is nonrotatably connected to the actuating shaft 6.

Figure 2:
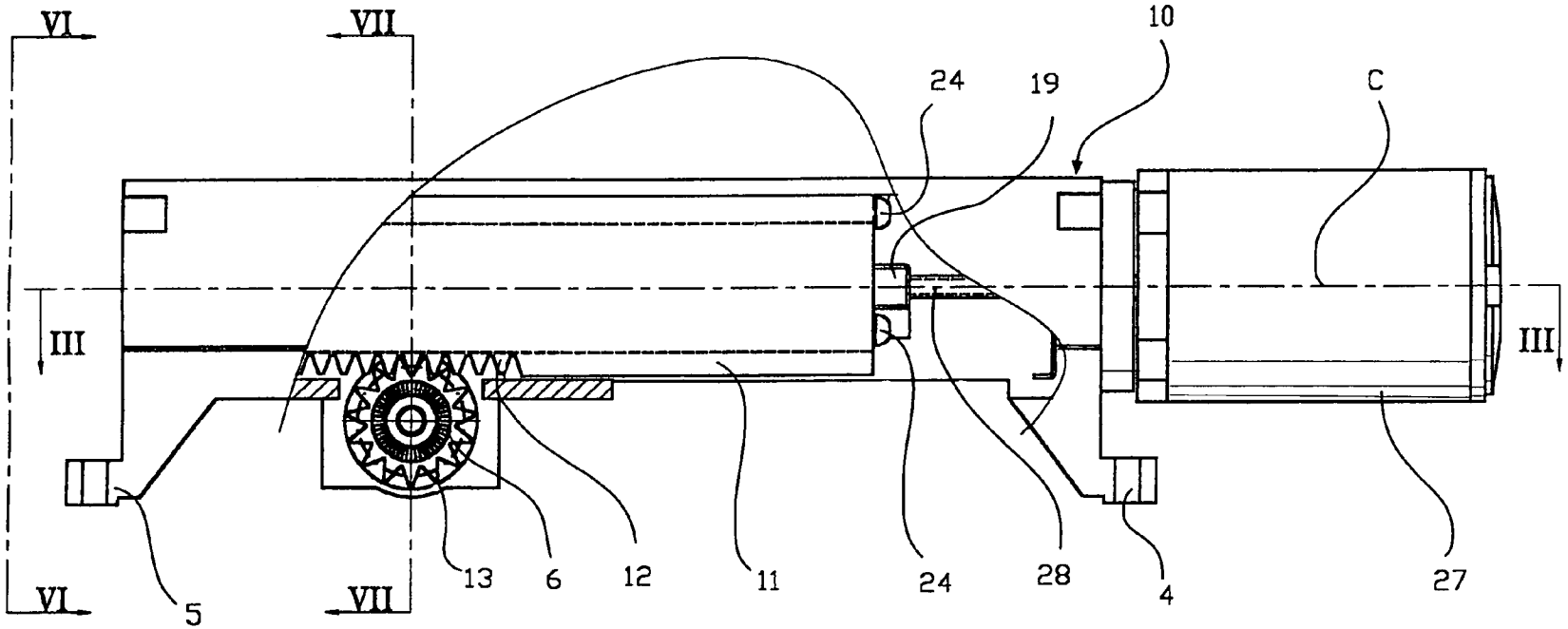
FIG. 2 is a view, partly in section, of the device along the line II-II in FIG. 1.

As shown in FIG. 2, the door opener 1 comprises an elongate casing or housing 10, a first elongate element 11 being slidably arranged therein by means of a bearing and, thus, axially displaceable in the housing 10. The element 11, which is cylindrical in shape, has on its outer surface first engaging means in the form of a gear rack 12, which meshes with second engaging means in the form of a gear rim 13 arranged on the actuating shaft 6.

Figure 3:
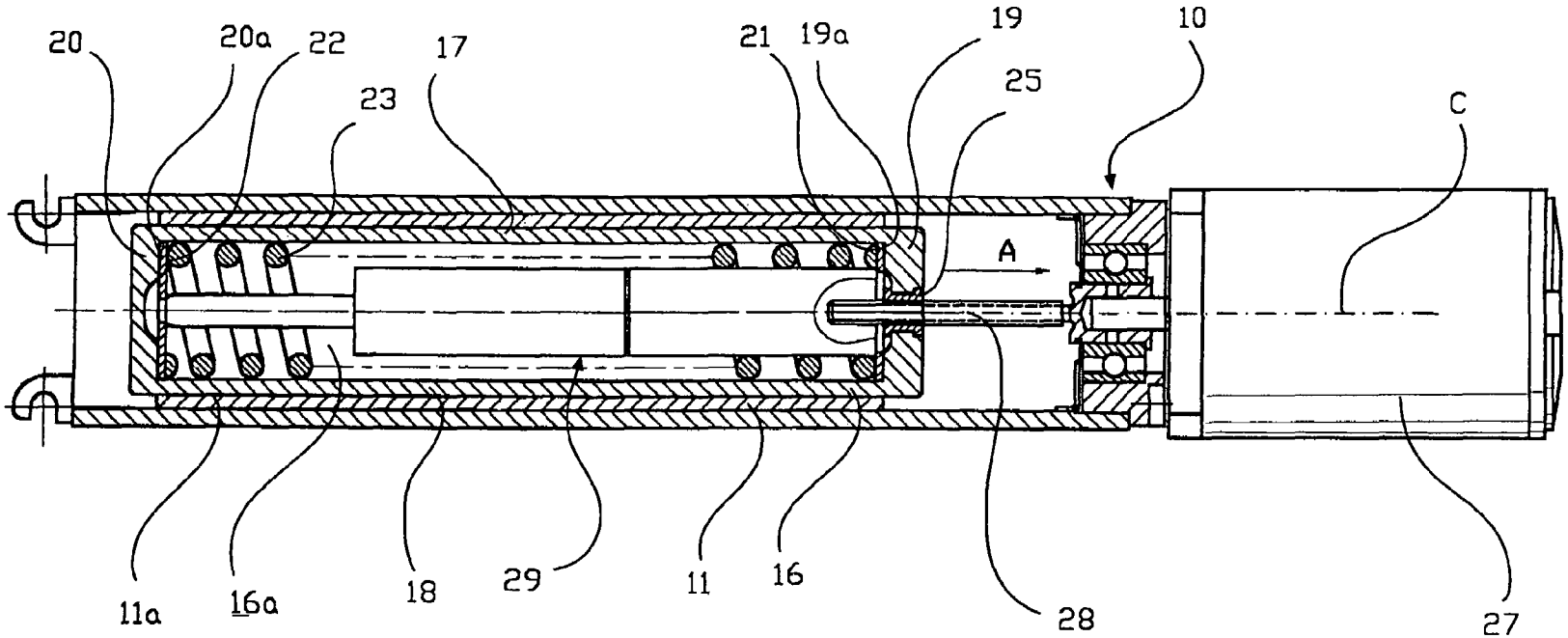
FIGS. 3-5 are axial sectional views along III-III in FIG. 2, illustrating three different positions.
Figure 4:
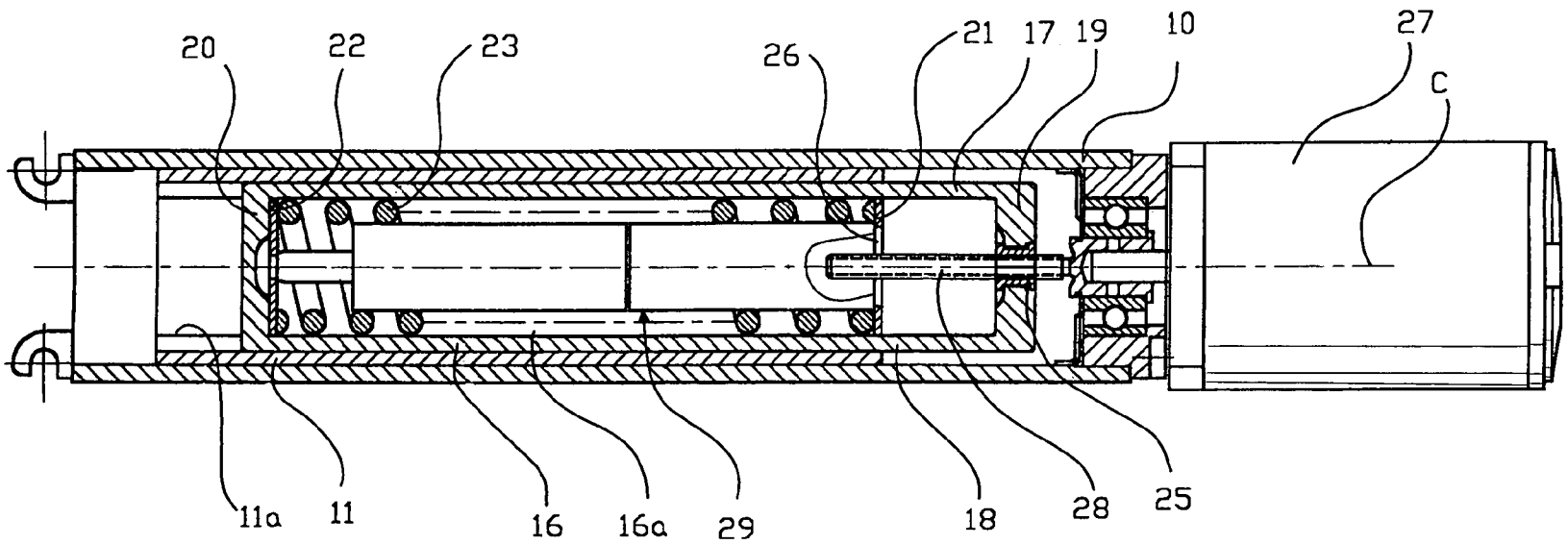
Figure 5:
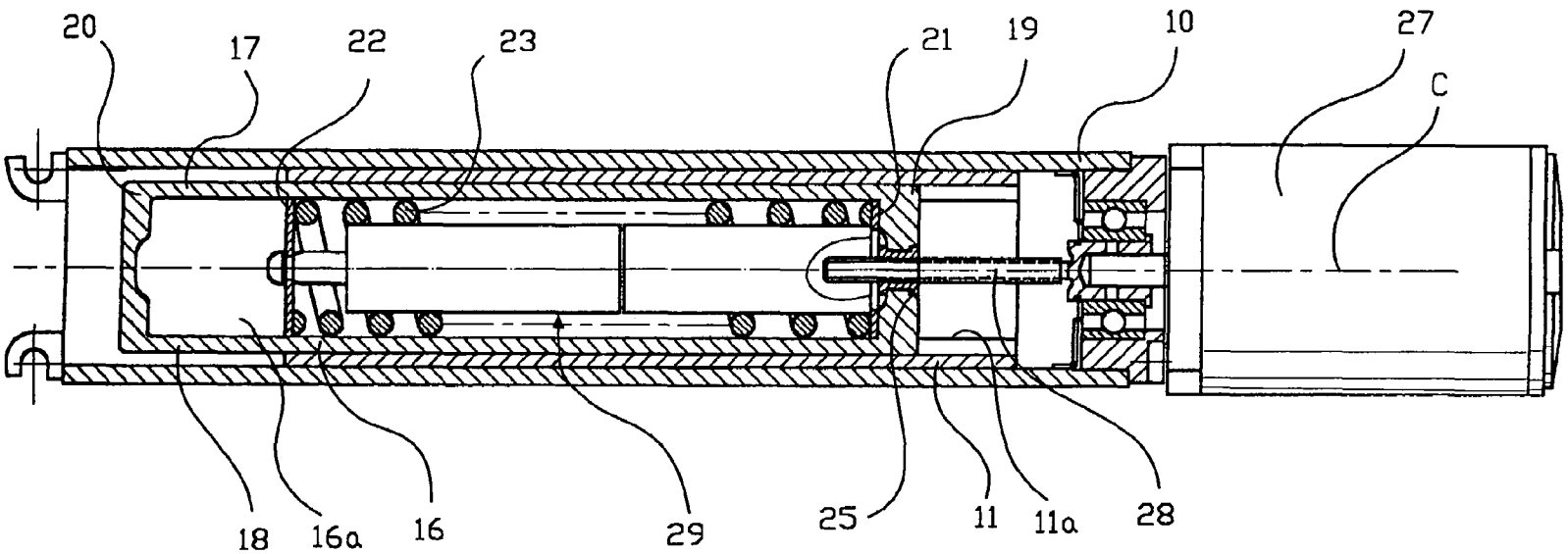
Figure 7:
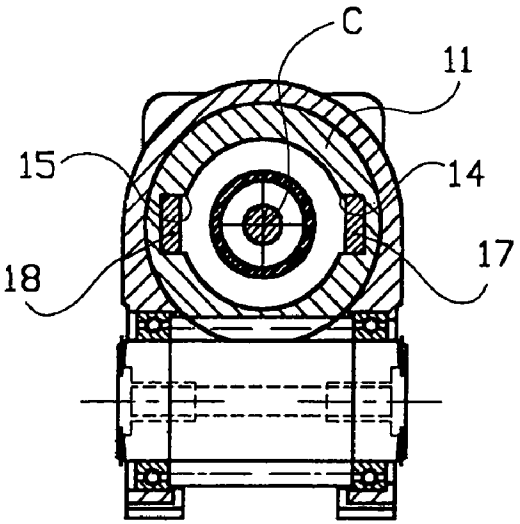
FIG. 7 is a cross-sectional view along VII-VII in FIG. 2.

As best seen in FIGS. 3-5, the element 11 has an axially extending bore 11*a*, in which two diametrically opposed grooves 14, 15 that extend in parallel along the whole length of the element 11 (see FIG. 7). In the grooves 14, 15, a second elongate element, in the form of a slide 16, is slidably arranged by means of a bearing and, thus, axially displaceable in the bore 11*a* of the element 11. The slide 16 has an elongate cavity 16*a* and has the form of a rectangular frame structure having opposite first and second side faces 17, 18 and two transverse first and second end pieces 19, 20 located axially at a distance from each other and having stop faces 19*a*, 20*a*. The side faces 17, 18 and the stop faces 19*a*, 20*a* define the rectangular cavity 16*a*. The axial displacement of the slide 16 in the grooves 14, 15 of the element 11 is thus effected by a displacement of the side faces 17, 18 of the slide 16 in said grooves 14, 15. The grooves 14, 15 and the two side faces 17, 18 of the slide 16 located therein are shown in FIG. 7.

The elements 11 and 16 thus form an axially displaceable actuator which is contained in the housing 10 and connected to the door leaf 2 via the actuating shaft 6. As can be seen in FIGS. 3-7, the elements 11 and 16 are coaxially arranged in the housing 10 relative to a centre axis C.

A biased spring means is arranged between the first and second stop faces 19*a*, 20*a*, here in the form of a pressure spring 23 (helical spring) located between associated first and second washers 21, 22. The washers 21, 22 abut against the ends of the spring 23, which are axially biased in the direction of the first and second stop faces 19*a*, 20*a*. Accordingly, the washers 21, 22 are located between the ends of the spring 23 and the stop faces 19*a*, 20*a*.

Figure 6:
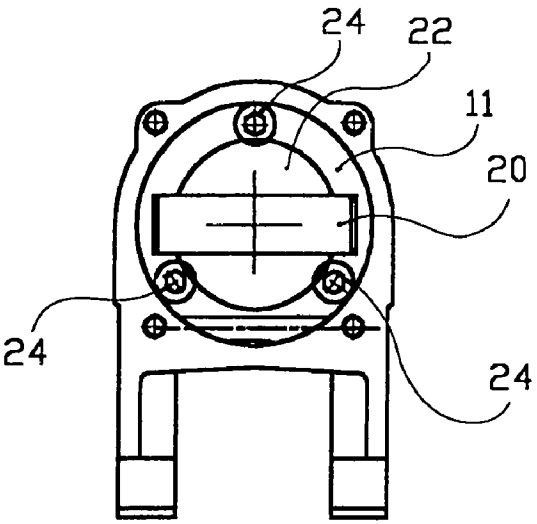
FIG. 6 is an end view along VI-VI in FIG. 2.

The washers 21, 22 are flat, circular disc elements with a diameter that is slightly smaller than that of the bore in the element 11 (see FIG. 6)

FIG. 6 shows the above-mentioned second washer 22 and the end piece 20. FIG. 6 further illustrates stop means in the form of screws 24 arranged at the end of the element 11. Similar screws 24 are to be found at the opposite end of the element 11, as shown clearly in FIG. 2. The screws 24 are attached to the ends of the element 11 in such manner that the heads of the screws 24 partially overlap and abut against the washers 21, 22. Thus, the washers 21, 22 cannot move past the screws 24, and the spring 23 and the washers 21, 22 will thereby be maintained inside the bore 11*a* of the element 11. The slide 16, however, is axially displaceable also outside the bore 11*a* of the element 11.

The first end piece 19 is provided with a threaded bearing 25 extending therethrough and arranged at the centre axis C of the element 11. The washer 21 abutting against the stop face 19*a* is provided with a corresponding through hole 26

(FIG. 4). A motor shaft 28 connected to a drive motor 27 is rotatably arranged in the threaded bearing 25. Thus, during operation of the drive motor 27, its motor shaft 28 will rotate in the threaded bearing 25 and pull the slide 16 axially back and forth along the motor shaft 28 in the bore 11*a* of the element 11.

Figure 8:
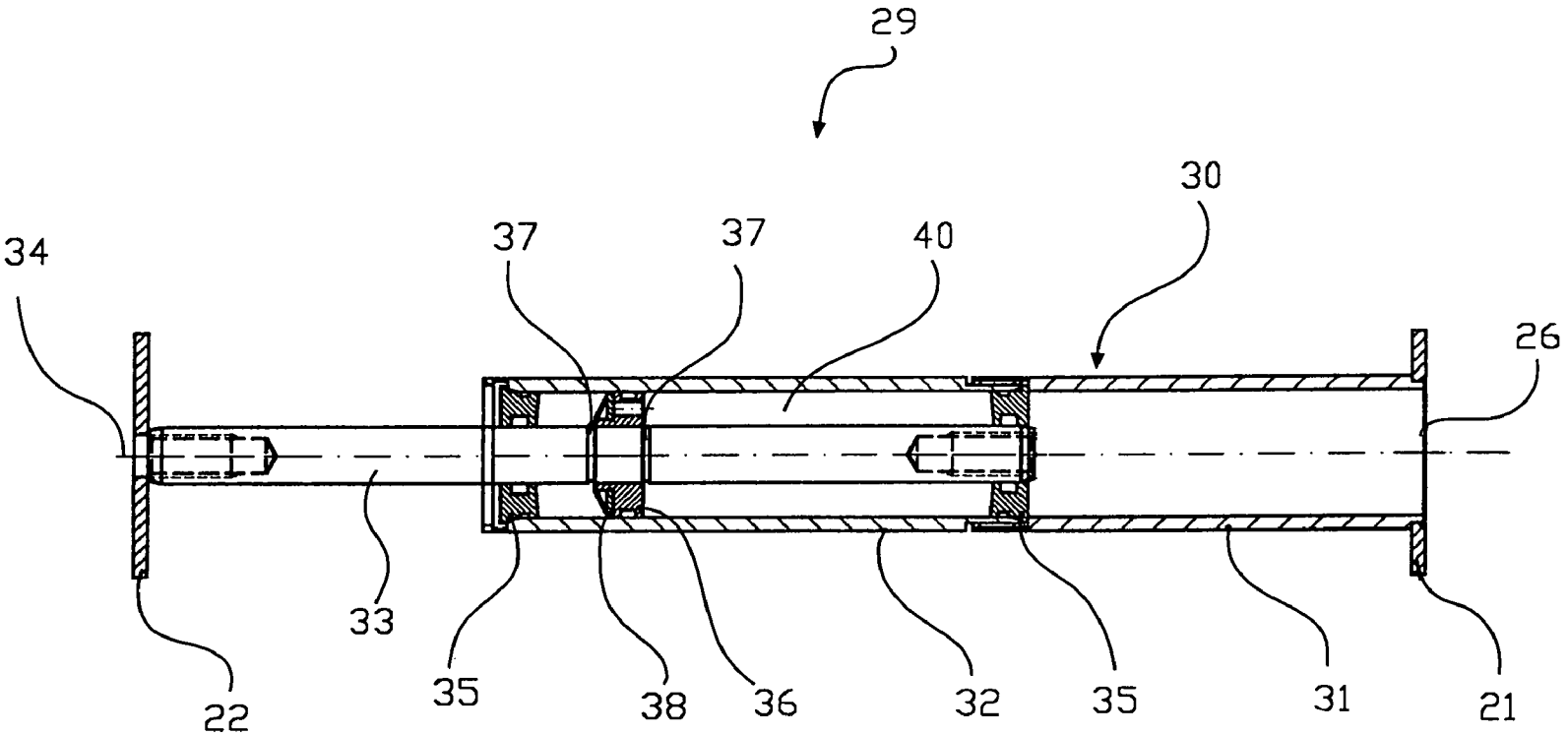
FIG. 8 is an axial sectional view of a damper means for a device according to the first embodiment of the invention.

The door opener 1 also comprises a damper means 29, which is shown in detail in FIG. 8. The damper means 29 is arranged inside the slide 16 and comprises an elongate damper housing 30 in the form of a first and a second housing portion 31, 32 connected to each other The division of the damper housing 30 into two portions 31, 32 is advantageous from a manufacturing perspective. The washer 21 is attached to the housing portion 31.

The damper means 29 further comprises a rod 33, one end of which is attached to the second washer 22 associated with the spring means 23. The attachment is carried out by means of a screw 34. The rod 33 is mounted by means of sealing rings 35 along the inner wall of said first portion 31. The sealing rings 35 have O-rings adapted to prevent leakage between on the one hand the rod 33 and the sealing rings 35 and, on the other, the sealing rings 35 and the second portion 32.

The rod 33 is displaceable in the second portion 32 of the damper housing 30. A piston 36 is fixedly mounted on the rod 22 and locked by means of locking rings 37 and abuts against the inner wall of the second portion 32. The piston 36 comprises a number of through holes which are parallel to the rod 33. A throttle washer 38 is arranged on the piston 36, said throttle washer 38 being pressed against the piston 36 by means of a spring washer. The surface between the piston 36 and the throttle washer 38 is formed with ducts (not shown) which extend from the above-mentioned through hole to the outer periphery of the piston 36. Hydraulic oil is provided in a space 40 between the sealing rings 35. When the rod 33 is axially displaced, the hydraulic oil will flow through the ducts and the holes from one side of the piston 36 to the other.

The use of the door opener 1 according to the first embodiment will now be described in more detail. The door opener 1 can be operated either manually by acting directly on the door leaf 2 or by means of the drive motor 27. FIG. 3 shows a starting position for the actuator comprising the two elements 11 and 16. FIG. 4 shows a situation in which the motor shaft 28 is rotating and the actuating shaft 6 is immobile (FIG. 2). FIG. 5 shows a situation in which the motor shaft 28 is immobile and the actuating shaft 6 is rotating.

When the door is opened manually, the door leaf 2 will be directly acted upon by someone either pulling or pushing it. The arm 8 connecting the door leaf 2 to the door opener 1 will thus be pivoted and will thereby act on the actuating shaft 6. The rotation of the gear rim 13 of the actuating shaft 6, which gear rim meshes with the gear rack 12 of the element 11, will then cause an axial movement of the element 11 in the housing 10. The slide 16 connected to the here idle motor 27 will remain immobile and the element 11 will be axially displaced relative to the immobile slide 16. This displacement is shown in particular in FIG. 5, in which the element 11 has been displaced in the direction indicated by the arrow A in FIG. 3.

As described above, the spring means 21, 22, 23 is permanently retained inside the element 11 by the stop means 24 abutting against the washers 21, 22 of the spring means. Thus, during said displacement of the element 11, the pressure spring 23 is compressed as the stop means 24, which abut against the slide's 16 second washer 22, advances the washer 22 and the spring 23 together with the element 11. Accordingly, the force used in manual opening is equivalent to the force required to compress the spring 23. Because there is no direct connection to the motor 27, which, thus, is not affected by a manual opening, as is the case in prior-art door openers, the door leaf 2 will open easily. After a manual opening, the door leaf 2 is closed by the force of the compressed spring 23. Consequently, the door leaf 2 does not have to be closed manually, but is closed by its own spring force. The speed of the rotary movement of the actuating shaft 6 during closing is reduced by the damper means 29. This prevents the door leaf 2 from 'slamming' close.

In motor-driven opening, the motor shaft 28 is rotated in the threaded bearing 25 in the first end piece 19 of the slide 16. During said rotation, the slide 16 will thus be partially displaced along the motor shaft 28. The power of the motor 27 is transmitted to the actuating shaft 6 by the elongate element 11 moving axially together with the slide 16. Therefore, the spring 23 will not be compressed and, thus, the power of the motor 27 will be used exclusively to operate the door leaf 2.

If, in motor-driven opening or closing, there is any object obstructing the door leaf 2, for example a person, the door leaf 2 and the actuating shaft 6 as well as, in turn, said element 11 will be maintained in their positions. The motor 27 will then displace the slide 16 in relation to the element 11, the force exerted on the obstacle (person) by the door leaf 2 being equivalent only to the force of compression of the spring 23. Thus, the power of the motor 27 will not be transmitted to a person getting in the way of the door leaf 2.

Figure 9:
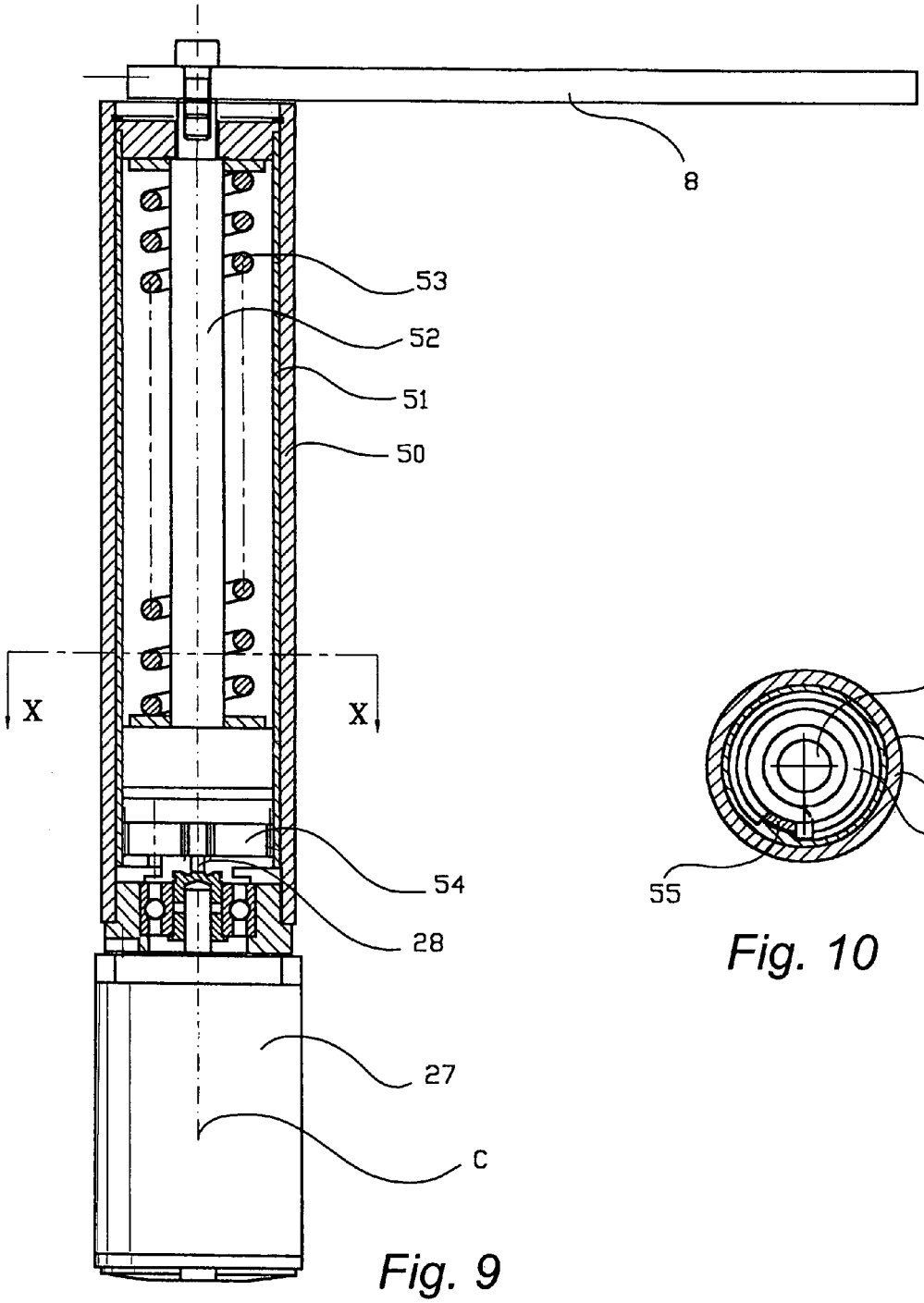
FIG. 9 is an axial sectional view of a device according to a second embodiment of the invention.
Figure 10:
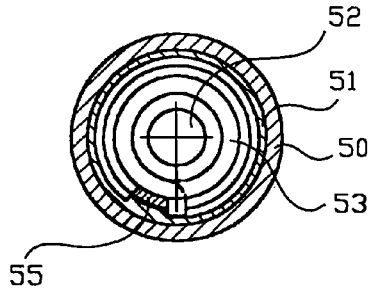
FIG. 10 is a cross-sectional view along X-X in FIG. 9.

FIGS. 9-10 show a device according to a second embodiment of the invention, which is based on rotary movement instead of axial movement as described above. In this case, the actuator arranged in a casing or housing 50 consists of a cylindrical element 51 which is rotatingly arranged in a bearing and which houses a trunnion 52 that is connected to the arm 8. The element 51 and the trunnion 52 are coaxially arranged in the housing 50 relative to the centre axis C. In terms of function, the element 51 corresponds to the slide 16 of the axial embodiment, while the trunnion 52 corresponds to the elongate element 11. In this embodiment, the axially acting pressure spring is replaced by a torsion spring 53 which is contained in the housing 50 and encloses the trunnion 52 and which, in turn, is enclosed by the rotatingly mounted element 51. Rotation of the element 51 via the motor shaft 28 driven by the motor 27 is made possible by a planetary gear 54 connected to the motor shaft 28 and the inside of the element 51. The trunnion 52 is non-rotatably connected to the arm 8.

The torsion spring 53 is adapted, via special stop means 55, to allow both motor-driven and manual operation of the door leaf 2 by analogy with that described above. In motor-driven opening, the motor 27 rotates the motor shaft 28, which rotates the two elements 51 and 52 jointly via the planetary gear so that the arm 8 is pivoted and the door leaf 2 opened In this connection, the function of the torsion spring 53 is to hold the elements 51 and 52 together. In manual opening, the arm 8 is pivoted by the door leaf 2 against the action of the torsion spring 53, which is tightened without affecting the motor shaft 28. Thus, the torsion spring 52 is rotated whereas the element 51 remains immobile.

Figures 11, 12:
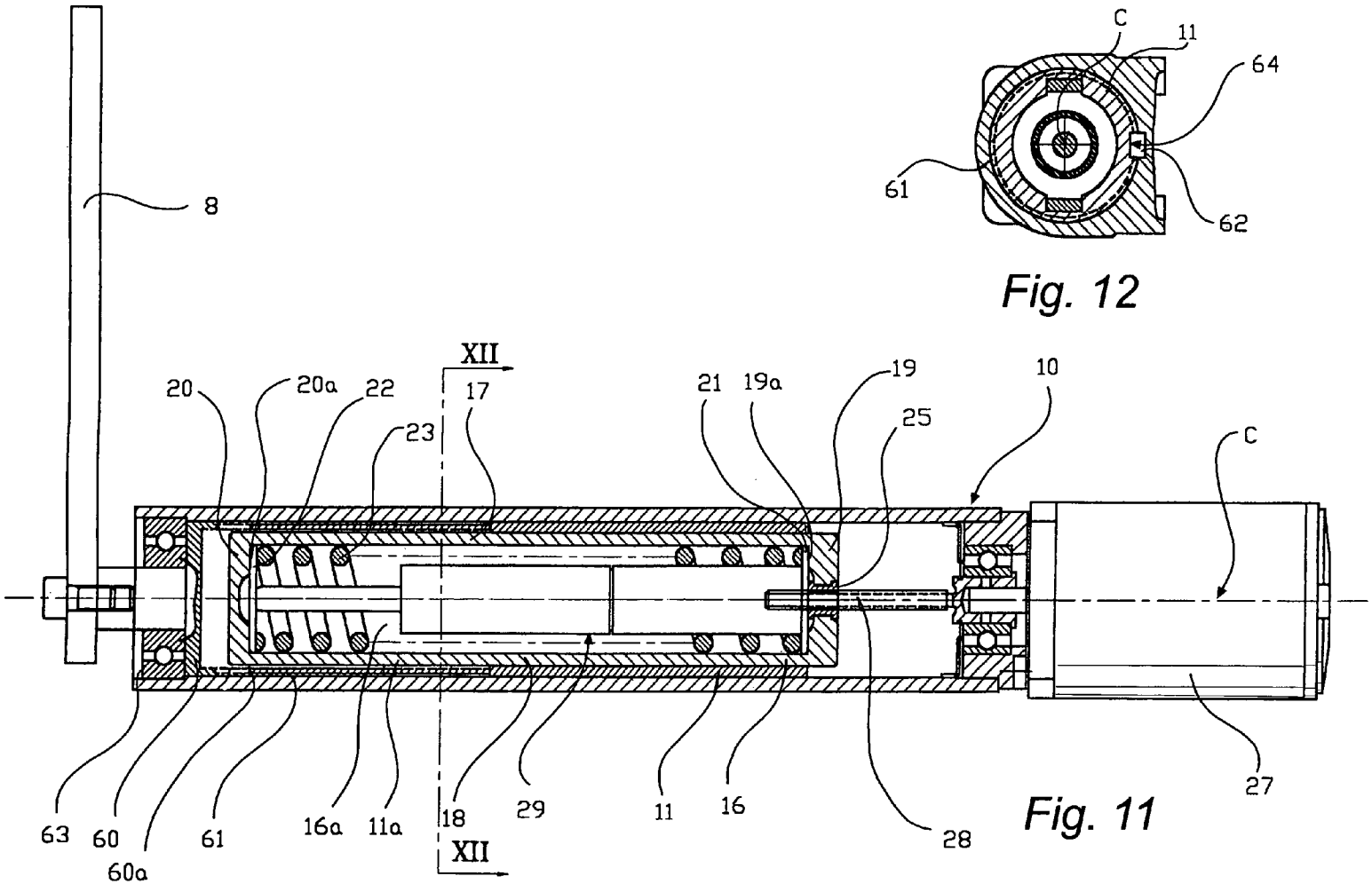
FIG. 11 is an axial sectional view of a device according to a third embodiment of the invention.
FIG. 12 is a cross-sectional view along XII-XII in FIG. 11.

According to a further embodiment, the two embodiments described above may be combined by the elements of the actuator being arranged so as to be both axially displaceable and rotatable in the housing. Such a further embodiment is shown in FIGS. 11-12, in which the equivalent of the actuating shaft 6 of the first embodiment is an actuating shaft 60 which is arranged coaxially with the centre line C. On the inside, the actuating shaft 60 is provided with a thread 60*a*, which in terms of function corresponds to the gear rim 13 of the first embodiment. Furthermore, the actuating shaft 60 is mounted in a bearing 63, which in turn is attached to the housing 10. On its outer surface, the element 11 has a thread 61, which in terms of function corresponds to the gear rack 12. The element 11 is further provided with a key way 64, in which a rotation-preventing means 62 is contained. The rotation-preventing means 62 is attached to the housing 10. The pitch of the thread 61 is so great that when the element 11 is displaced in the axial direction between its end positions, the actuating shaft 60 will rotate between its end positions.

To summarize the above described embodiments, the door opener has an actuating means comprising two elements which are spring-loaded with the aid of a biased spring means in such manner that both elements are either displaceable/rotatable jointly by means of the drive motor for operating the door leaf or displaceable/rotatable relative to each other upon external activation of the door leaf.

The elements are interconnected via the spring means in such manner that the pivoting motion of the door leaf and the rotation of the drive motor (via the motor shaft), respectively, can be absorbed by and stored up in the spring means independently of each other.

Controlling the Operation of the Door Opener

The door opener according to the invention may be provided with a control function, which means that certain predetermined parameters can be varied. Examples of variable parameters are the position of the door leaf when closed and fully opened, respectively. The opening speed and closing speed of the door leaf can also be set. A further parameter that may be set is the hold-open time.

The control function is also regulated so that certain signals to the door opener will result in certain predetermined operations of the door. For example, a signal from an opening button to be used by disabled people will result in a specific hold-open time.

The control is further regulated by two sensors associated with the door. One of the sensors is a position sensor indicating the position of the element in the housing, while the other is an angle sensor indicating the angle of rotation of the motor shaft. By means of said sensors, a relationship between the number of revolutions of the motor shaft a and the position of the element $\gamma$ (mm) is obtained.

When the door opener moves without the helical spring being compressed, i.e. in motor-driven unobstructed opening of the door, the relationship $\gamma=\text{constant}\times\alpha$ applies. If, however, the door leaf is manually operated, $\gamma$ will change while $\alpha$ will remain unchanged. In the preferred embodiment, the following applies: If $-2<\gamma-\text{constant}*a<2$, the motor is not affected. If ($\gamma-\text{constant}*a$) lies outside the above range, the motor will start and run until $$|\gamma-\text{constant}*a|<0.5.$$

Thus, by means of the above-mentioned sensors, a combined manual and motor-driven opening can be carried out. If the door leaf is pivoted manually through the first degrees (about 5 degrees), the motor can then be started. Because the spring will be somewhat compressed by the partial manual opening, the manual opening can continue without the spring having to be compressed further, and the door leaf will thus swing freely and open very easily.

Alternative Embodiments of the Invention

It should be pointed out that the invention is applicable to many types of doors, such as hinge doors, swing doors, folding doors and balance doors, as well as covers and gates of different kinds (including windows). In addition, the door opener can be mounted directly on the door leaf, alternatively integrated therein. Furthermore, it will be apparent that the connection between the door leaf and the door opener can be made by means of different arm systems. The invention may also be applied to so-called pivot hinged doors, in which there is no arm system but the actuating shaft arranged on the door opener acts directly on a hinge on the door leaf to be operated. This action may take place via a gear step.

To conclude, it should be observed that further modifications of the above door opener according to the invention are possible within the scope of the invention, as defined in the appended claims. The spring means may, for instance, be of a design other than the one described above.

The invention claimed is:

1. A device for opening and closing a pivotally mounted door leaf, comprising:

the door leaf; and an actuator, which is at least one of displaceably and rotatably arranged in a casing and connected to the door leaf and which, during at least one of displacement and rotation, actuates said door leaf, and a drive motor which is connected to the actuator for providing at least one of displacement and rotation thereof, the actuator including a first element which is connected to the door leaf, and a second element which is connected to the drive motor, wherein the first and second elements are interconnected by a biased spring in such manner that a movement of the door leaf and a rotary movement of the drive motor, respectively, are taken up by and stored in the biased spring independently of each other, the biased spring being enclosed by the second element.

2. A device according to claim 1, in which the first and second elements are telescopically interconnected, the biased spring being contained in the first and second elements.

3. A device according to claim 2, in which the first element is axially displaceable in the casing, the second element being contained in the first element and axially displaceable therein.

4. A device according to claim 2, in which the first element has an engaging element which engages a corresponding engaging element of an actuating shaft projecting from the casing and being adapted to actuate the door leaf, the drive motor being connected to the second element, which is contained in the first element.

5. A device according to claim 1, in which the biased spring includes an axially biased pressure spring contained in the second element.

6. A device according to claim 1, in which the first element includes a trunnion, which is contained in the casing and enclosed by the second element and with the biased spring arranged there between, the biased spring includes a torsion spring which at either end is connected to the elements.

7. A device according to claim 1 in which the biased spring is arranged between and connected to the first and second elements included in the actuator.

8. A device according to claim 1, in which the first and second elements of the actuator are intended for axial displacement as well as rotation.

9. A device according to claim 8, in which the biased spring of the actuator serves both as compression spring and torsion spring.

10. A device according to claim 1, which further comprises a damper adapted to dampen the movements of the actuator.

11. A device according to claim 1, in which at least two sensors including an angle sensor and a position sensor are arranged adjacent to a motor shaft and along the first element, respectively.

12. A device according to claim 1, in which the drive motor has a threaded motor shaft threadably engaging a threaded bearing at one end of the second element.

13. A door structure, including the device according to claim 1.

14. A door structure according to claim 13, which further includes a door frame and the pivotally mounted door leaf, the device for opening and closing being mounted in the pivotally mounted door leaf.

* * * * *